US007948347B2

(12) United States Patent
Maruyama et al.

(10) Patent No.: US 7,948,347 B2
(45) Date of Patent: May 24, 2011

(54) MULTI-STAGE COIL FOR TRANSFORMER, AND COIL WINDING METHOD AND APPARATUS FOR MANUFACTURING THE SAME

(75) Inventors: Eisuke Maruyama, Tainai (JP); Toshio Ogata, Tainai (JP); Jyunichi Ishizuki, Tainai (JP)

(73) Assignee: Hitachi Industrial Equipment Systems Co.,, Tokyo (JP)

( * ) Notice: Subject to any disclaimer, the term of this patent is extended or adjusted under 35 U.S.C. 154(b) by 0 days.

(21) Appl. No.: 12/849,052

(22) Filed: Aug. 3, 2010

(65) Prior Publication Data

US 2010/0295647 A1 Nov. 25, 2010

Related U.S. Application Data

(62) Division of application No. 12/369,758, filed on Feb. 12, 2009, now Pat. No. 7,793,880.

(30) Foreign Application Priority Data

May 15, 2008 (JP) ..... 2008-128193

(51) Int. Cl.
*H01F 5/00* (2006.01)

(52) U.S. Cl. ..... 336/200; 336/223; 336/232; 29/602.1

(58) Field of Classification Search ..... 336/223, 336/232, 200
See application file for complete search history.

(56) References Cited

U.S. PATENT DOCUMENTS

| | | | | |
|---|---|---|---|---|
| 3,771,086 A | | 11/1973 | Poulsen | |
| 4,554,731 A | | 11/1985 | Borden | |
| 4,593,815 A | | 6/1986 | Wright | |
| 4,635,457 A | | 1/1987 | Ishii et al. | |
| 4,761,628 A | * | 8/1988 | Nishi et al. | 336/180 |
| 5,584,438 A | | 12/1996 | Jagersberger | |
| 6,216,513 B1 | | 4/2001 | Nakamura et al. | |

FOREIGN PATENT DOCUMENTS

| | | | |
|---|---|---|---|
| JP | 7142263 | | 6/1995 |
| JP | 407142263 A | * | 7/1995 |
| JP | 9082551 | | 3/1997 |
| JP | 09306757 | * | 9/1997 |
| JP | 10-092681 | | 4/1998 |
| JP | 2000-069721 | | 3/2000 |
| JP | 2000-252149 | | 9/2000 |
| JP | 2003209023 | * | 7/2003 |
| JP | 2004-055714 | | 2/2004 |
| JP | 200455714 | * | 2/2004 |
| JP | 2006-196682 | | 7/2006 |

* cited by examiner

*Primary Examiner* — Anh T Mai

(74) *Attorney, Agent, or Firm* — Antonelli, Terry, Stout & Kraus, LLP.

(57) ABSTRACT

At least two or more flat rectangular wires having been fed separately or simultaneously (two or more are superimposed) are integrated by being pinched in a width direction and a thickness direction by at least two or more pairs of rollers and are rolled and formed simultaneously in a forming part to be formed into two or more flat rectangular electric wires. The two formed electric wires are stacked in layers in a wind-up part while being wound into a disk shape to provide a multi-stage coil. Two or more systems up to the forming part of the winding apparatus may be disposed in a planar layout. Each system may supply one flat rectangular electric wire separately, and the supplied electric wires may be stacked in layers in the wind-up part while being superimposed. The coil may be molded entirely.

18 Claims, 6 Drawing Sheets

MULTI-STAGE COIL FOR TRANSFORMER, AND COIL WINDING METHOD AND APPARATUS FOR MANUFACTURING THE SAME

CROSS-REFERENCE TO RELATED APPLICATION

This application is a divisional application of U.S. application Ser. No. 12/369,758, filed Feb. 12, 2009, now U.S. Pat. No. 7,793,880 the contents of which are incorporated herein by reference.

INCORPORATION BY REFERENCE

The present application claims priority from Japanese application No. 2008-128193 filed on May 15, 2008, the content of which is hereby incorporated by reference into this application.

BACKGROUND OF THE INVENTION

1. Field of the Invention

The present invention relates to a multi-stage coil for a transformer which is formed by winding at least two or more flat rectangular electric wires in multiple stages and is used for a mold transformer, and to a winding method and apparatus for manufacturing the same.

2. Description of Related Art

Conventionally, there has been described an art in which in order to manufacture a multi-stage coil efficiently, a flat rectangular electric wire is rolled in a sheet thickness direction by paired pressure rollers by using motor power, and thereafter, the flat rectangular electric wire is wound concentrically to form an annular coil, and particularly, there has been stated that the above described paired pressure rollers are configured to be able to change the pressing angle of the flat rectangular electric wire in the sheet thickness direction in accordance with the radius of curvature of a curved portion of the coil (Japanese Patent No. 3996005). Further, as an art of manufacturing a winding coil of a flat conducting wire (flat rectangular electric wire) by using a round conducting wire with insulating coating, there has been described an art in which after a round conducting wire with insulating coating is passed between pressure rollers and deformed to be a flat conducting wire, the conducting wire is wound up in the form of a coil (JP-A-2000-69721).

In the art disclosed in Japanese Patent No. 3996005, the rolling is performed in accordance with a predetermined radius of curvature of the curved portion (corner portion) of the coil by changing the pressing angle of the pressure rollers against the flat rectangular electric wire. Therefore, when the radius of curvature is small, or the rolling deformation amount in the sheet thickness direction by the pressure roller is large, the insulating material such as an insulating sheet or an insulating film which is wound on the electric wire easily breaks at the time of rolling, and therefore, there is the fear of occurrence of short circuit and the like. Further, while the shape of the coil may change due to the inclination of the pressure roller, the pressing amount against the electric wire, the size variation of the electric wire material and the variation of a material characteristic such as malleability, it is difficult to modify the coil shape. Further, in the case of the art disclosed in JP-A-2000-69721, it is nothing but an art of providing a coil shape by automatically winding a flat conducting wire (flat rectangular electric wire) formed by rolling a round conducting wire with insulating coating, and there is the fear of easily causing breakage of the insulating coating, and reduction in conductor occupation rate and the like in the curve portion (corner portion) of the coil.

Thus, as an art of relating to an annular coil for a transformer and the like, and especially forming a curved portion such as a corner portion of the coil by deforming the sectional shape of the conductive element wire, there has been proposed, in connection with a coil element wire portion forming the curved portion of the annular coil, the coil element wire is rolled by a first roller so that the deformation amount of a portion near the outer peripheral side of the annular coil in its section is larger than that of a portion near the inner peripheral side to achieve bending deformation in the lengthwise direction, and thereafter, the above described element wire portion which is deformed in section is further deformed by being bent in the lengthwise direction by a second roller. In the annular coil used for a transformer or the like, breakage of the insulating coating and reduction in conductor occupation rate are prevented even in a curvilinear portion (curved portion) such as a corner portion of the annular coil so as to eliminate the breakage of the insulating coating and enable reduction of loss. There is proposed an annular coil, a coil manufacturing device, a coil manufacturing method and a transformer (JP-A-2006-196682).

In the art described in Japanese Patent No. 3996005, the corner radius is formed by rolling one flat rectangular wire in the sheet thickness direction by a forming roller, and a straight portion is formed by linearly feeding the flat rectangular wire after releasing rolling. That is, as a coil for a transformer, it is a single-wound coil. However, in order to increase the transformer capacity, increase in size of the flat rectangular electric wire used for a coil, in other words, the sectional area of a single wire is required. However, in the case of increasing the size in the case of the single wire, there is a limit in manufacturing, such as a technical problem in manufacturing the electric wire itself, cost, a technical problem of the manufacturing device itself such as a wire winding apparatus and the like.

BRIEF SUMMARY OF THE INVENTION

Accordingly, while it is unnecessary to change the size of each flat rectangular electric wire used for a coil from a conventional one, there is the problem to be solved in respect of establishing a multi-stage coil for a transformer capable of corresponding to increase in transformer capacity by being combined with another one, and a winding method and a winding apparatus for manufacturing the same.

An object of the present invention is to provide a multi-stage coil for a transformer capable of corresponding to increase in capacity by combining, forming and winding at least two or more flat rectangular wires (single wires), and winding method and apparatus for manufacturing the same.

In order to solve the above described problem, a winding apparatus of a multi-stage coil for a transformer according to this invention includes a supply part which supplies a plurality of flat rectangular electric wires separately or in a superimposed state, a forming part which rolls and forms an electric wire portion which will become a curved portion when the flat rectangular electric wires are wound into a disk shape, and a wind-up part which stacks the flat rectangular electric wires having been formed in the forming part in layers while winding the flat rectangular electric wires into the disk shape, and is characterized in that the forming part forms the plurality of flat rectangular electric wires having the same shape and the same size separately or simultaneously, and the wind-up part stacks the plurality of formed flat rectangular electric wires in layers while winding the flat rectangular electric wires into the disk shape in a vertically superimposed state.

Further, a winding method of a multi-stage coil for a transformer according to this invention includes: rolling and forming electric wire portions which will become curves portions when a plurality of flat rectangular electric wires having been supplied separately or in a superimposed state are wound into a disk shape; and stacking the flat rectangular electric wires having been rolled and formed in layers while winding the wires into the disk shape, and is characterized by including: forming the plurality of flat rectangular electric wires having the same shape and the same size separately or simultaneously; and stacking the plurality of formed flat rectangular electric wires in layers while winding the wires into the disk shape in a state where the flat rectangular electric wires are superimposed vertically.

Further, a multi-stage coil for a transformer according to this invention is formed by stacking the plurality of flat rectangular electric wires in layers, of which electric wire portions corresponding to curve portions after being wound into a disk shape have been rolled and formed, while winding the plurality of flat rectangular electric wires into the disk shape in a state where the flat rectangular electric wires are superimposed vertically.

According to the present invention, when winding the flat rectangular electric wires into disk shapes in multiple stages, since at least two or more flat rectangular electric wires are wound in multiple stages in a state where the two or more flat rectangular electric wires are superimposed, it is possible to obtain the same effect as the case of increasing the sectional area of the electric wire. More specifically, in the winding apparatus, the flat rectangular electric wires having been fed separately or simultaneously (two or more are superimposed) are integrated by being pinched in the width direction and the thickness direction by at least two or more pairs of rollers, and are simultaneously formed in a superimposed state, whereby two or more flat rectangular electric wires can be simultaneously formed. The flat rectangular electric wires thus formed can be stacked in layers while winding the wires into a disk shape by a wind-up part. Further, in another embodiment, it is possible to separately flat rectangular electric wires one by one respectively, and superimposing the electric wires to stack those in layers at the wind-up part, whereby two or more flat rectangular electric wires can be wound in multiple stages.

Further, by disposing two or more systems consisting of parts up to the forming part of the winding apparatus in the left and right direction in the plane layout or in a direction which does not cause interfere with at least one winder, and separately supplying flat rectangular electric wires one by one respectively so as to superimposed and stack the flat rectangular electric wires in layers at the wind-up portion, two or more flat rectangular electric wires can be wound and stacked in multiple stages of disk winding shapes. Further, by adding the function of working two or more electric wires into a flattened one from round wires instead of the flat rectangular electric wires, the electric wires can be wound in multiple stages while working at least two or more wires into a flat rectangular shape in-line.

According to the present invention, since at least two or more electric wires are used, multiple stage winding is achieved by stacking the wires in layers while winding those into a disk shape, and increase in capacity of a winding coil for a transformer can be realized, the transformer can be developed to a large model. Further, the number of wires can be increased to be two or more, and a route for applying the coil to a larger model can be achieved. Further, according to the present invention, the sectional area of the combined electric wires can be made large without changing the size of the respective electric wires, and therefore, increase in capacity of a mold transformer can be realized. Further, in the winding apparatus, it is possible to realize in-line operation of the working process such as flattening work.

Other objects, features and advantages of the invention will become apparent from the following description of the embodiments of the invention taken in conjunction with the accompanying drawings.

Hereinafter, the embodiments of winding apparatus of a multi-stage coil for a transformer according to the present invention will be described based on the drawings.

DETAILED DESCRIPTION OF THE INVENTION

Embodiment 1

Figure 1A:
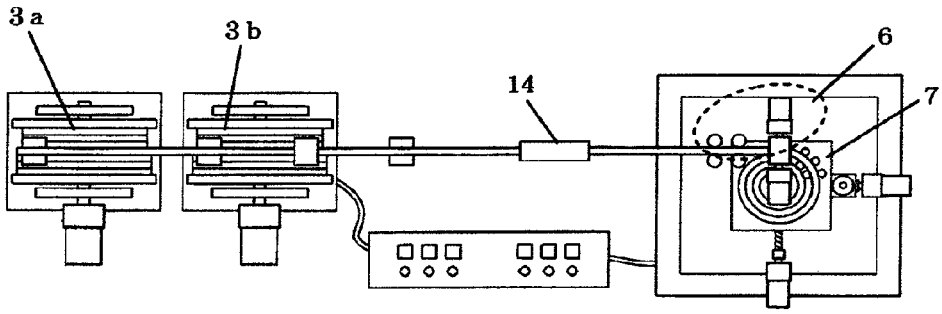
FIGS. 1A to 1C are general schematic views showing embodiment 1 of a winding apparatus of a multi-stage coil for a transformer according to the present invention.
Figure 1B:
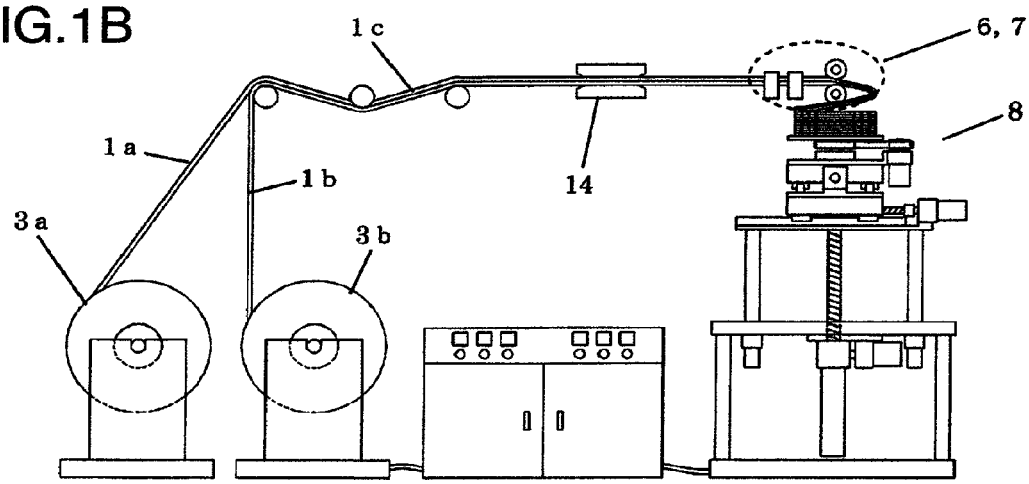
Figure 1C:
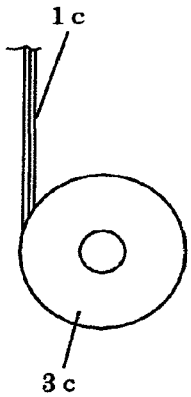

FIGS. 1A to 1C are general schematic views showing embodiment 1 of a winding apparatus of a multi-stage coil for a transformer according to the present invention, FIG. 1A is a plane view, and FIG. 1B is a front view. As shown in FIGS. 1A to 1C, flat rectangular electric wires 1*a* and 1*b* which have been wound on individual wire drums 3*a* and 3*b* are superimposed in a vertical direction immediately after being fed from the wire drums 3*a* and 3*b*, and are supplied to a wind-up part 8 in that state. The wind-up part 8 is adjustable in position in a plane, and is provided so as to be capable of ascending and descending by a mechanism like a screw mechanism in accordance with stacking of the coil. A supply part of the flat rectangular electric wires 1*a* and 1*b* includes a feeding device 14 and various guide rollers. The flat rectangular electric wires 1*a* and 1*b* are fed to a forming part (integrally combining part) 6 while being fed by a predetermined amount by the feeding device 14. The winding apparatus shown in FIGS. 1A to 1C is the one which can be called a two-superimposing type, in which two flat rectangular electric wires 1*a* and 1*b* having the same shape and the same size are supplied separately, and superimposed on the way, and the superimposed electric wires are simultaneously formed and wound in a disk form. The disk winding mentioned here is not limited to a circular shape, but includes winding in a rectangular shape. In addition, the same shape and the same size mentioned here do not necessarily have to be the same shape and same size in strict meaning. That is, in the coil which is wound in the stacked disk form, a little margin may be included between the coils in the stacked state, and between the adjacent wound wires, and therefore, it is sufficient that those have substantially the same shape and size like different shapes and sizes but close to each other.

Figure 2:
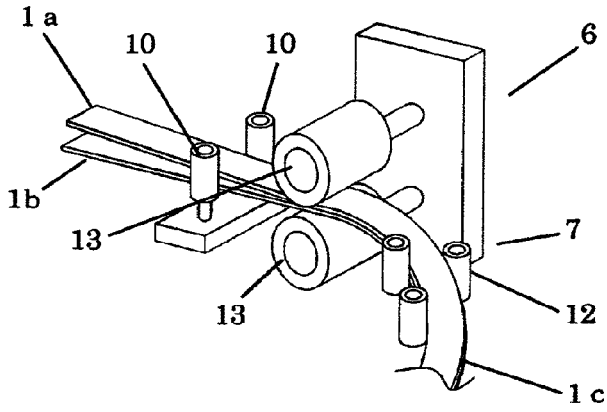
FIG. 2 is a perspective view showing a forming part of the winding apparatus shown in FIGS. 1A to 1C.

FIG. 2 is a perspective view showing the forming part of the winding apparatus shown in FIGS. 1A to 1C. As shown in FIG. 2, the forming part 6 includes a forming unit 7 having forming rollers 13 and 13, guide rollers 10 and 10 which guide feeding of the flat rectangular electric wires 1*a* and 1*b* before forming, and a group of guide rollers 12 which guides feeding of the flat rectangular electric wires 1*a* and 1*b* after forming. The flat rectangular electric wires 1*a* and 1*b* are guided in the width direction of the electric wires by at least the pair of guide rollers 10 and 10, and are fed into a space between the forming rollers 13 and 13.

The forming rollers 13 and 13 perform rolling work for portions to be the curved portions of the disk winding, and perform curving by more firmly rolling the outer side of the curved portion in the curvature radius direction than the inner side thereof. Accordingly, the guide rollers 10 and 10 accurately perform position guide in the width direction. In this example, since the wind-up part 8 winds up the coil as a circular coil, the flat rectangular electric wires 1*a* and 1*b* which are linearly fed are continuously rolled and formed by the forming rollers 13 and 13, to form a curved combined electric wire 1*c*. The group of guide rollers 12 consists of at least three guide rollers, and guides the curved combined electric wire 1*c* downwardly into a disk winding shape in the wind-up part 8 to be stacked in layers.

In the example shown in FIGS. 1 to 2, the flat electric wires 1*a* and 1*b* have been separately wound up around the wire drums 3*a* and 3*b*, but as shown in FIG. 1C, the same object can be also achieved by setting a drum 3*c* having the combined electric wire 1*c* (but before forming) with two or more wires being superimposed and wound in advance. If the combined electric wire 1*c* in the state of two wires superimposed is delivered from the beginning, the combined electric wire 1*c* only has to be directly supplied to the winding apparatus, and the superimposing step is not necessary. As for the concrete winding mechanism, the disk winder as shown in Japanese Patent No. 3996005 may be used.

Embodiment 2

Figure 3A:
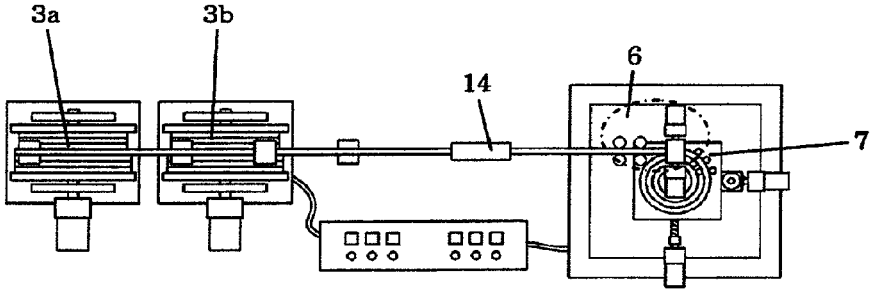
FIGS. 3A and 3B are general schematic views showing embodiment 2 of a winding apparatus of a multi-stage coil for a transformer according to the present invention.
Figure 3B:
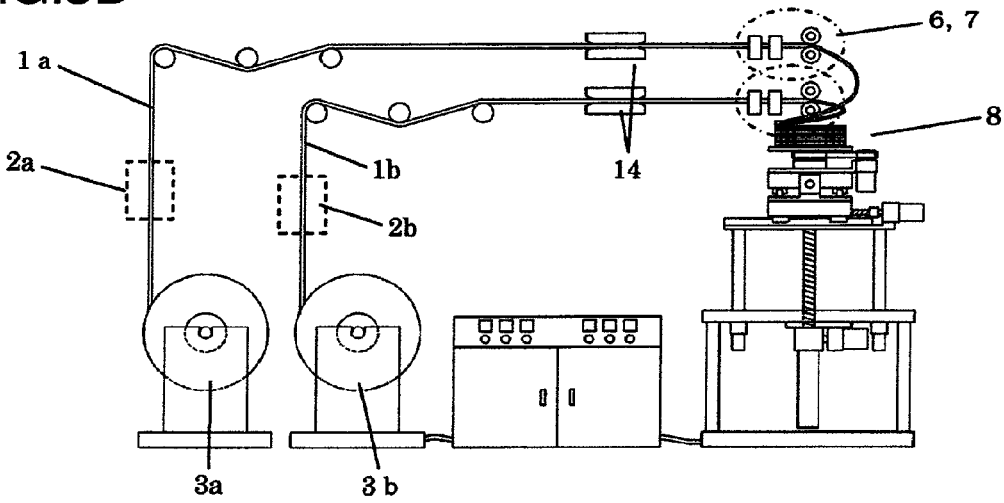

FIGS. 3A and 3B are general schematic views showing embodiment 2 of the winding apparatus of a multi-stage coil for a transformer according to the present invention, FIG. 3A is a plane view, and FIG. 3B is a front view. In embodiment 2 shown in FIGS. 3A and 3B, a supply part is two supply parts respectively having routes in which the flat rectangular electric wires 1*a* and 1*b* which are wound around individual wire drums 3*a* and 3*b* are vertically disposed individually, and the flat rectangular electric wires 1*a* and 1*b* which are respectively supplied by the supply parts are formed by separate forming parts 6 and 6 respectively. The other structure as an apparatus is similar to the one included in embodiment 1 except for the electric wire working device, and therefore, redundant explanation will be omitted.

Figure 4:
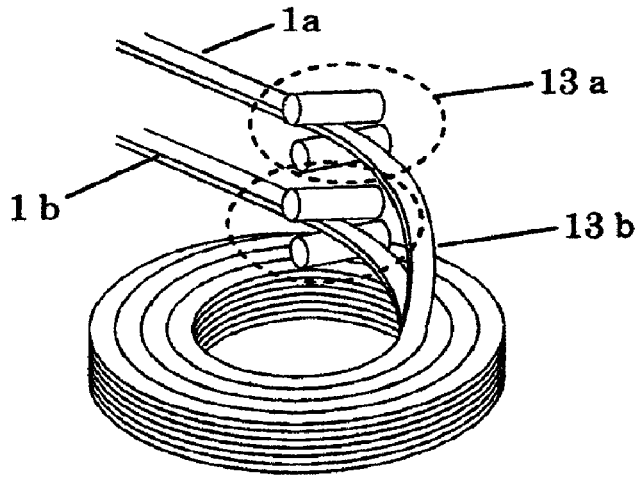
FIG. 4 is a perspective view showing a forming part of the winding apparatus shown in FIGS. 3A and 3B.

FIG. 4 is a perspective view showing the forming part of the winding apparatus shown in FIGS. 3A and 3B. As shown in FIG. 4, the forming unit 7 in the forming part 6 includes a forming roller 13*a* which forms the flat rectangular electric wire 1*a*, and a forming roller 13*b* which forms the flat rectangular electric wire 1*b*. The way of forming by the forming rollers 13*a* and 13*b*, the guide action of the guide rollers may be equivalent to the forming rollers 13 and 13 and the guide rollers 10 and 12 shown in FIG. 2, and therefore, redundant explanation will be omitted. The winding apparatus according to embodiment 2 can be called a double deck type because the vertically separate flat rectangular electric wires 1*a* and 1*b* are delivered separately, are formed into a circular arc shape by adding an angle thereto by the separate forming rollers 13*a* and 13*b*, and are combined and superimposed in the wind-up part 8 which is the final step so as to be stacked in layers into a disk winding shape.

Figure 5:
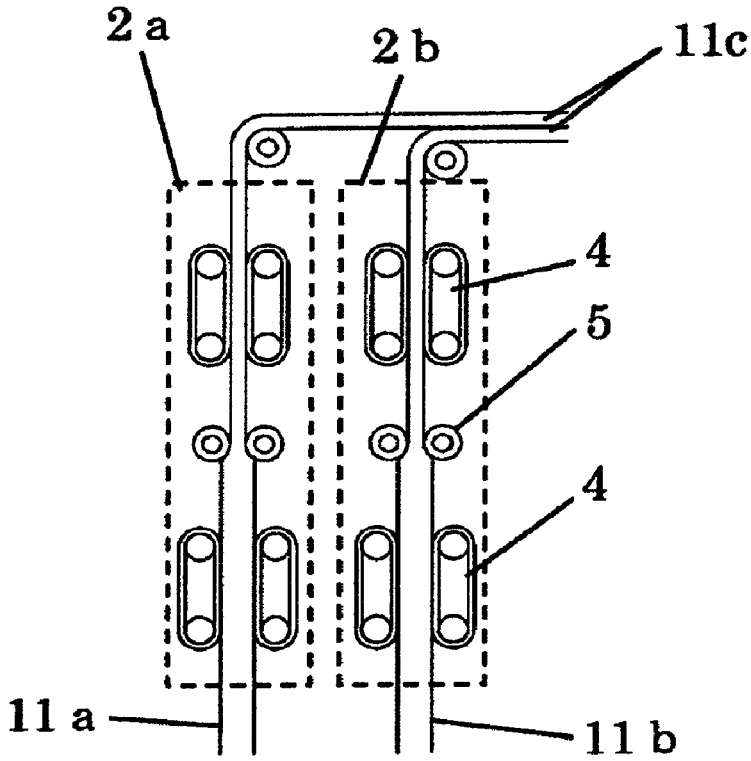
FIG. 5 is an explanatory view showing an outline of an electric wire working device shown in FIGS. 3A and 3B.
Figure 6A:
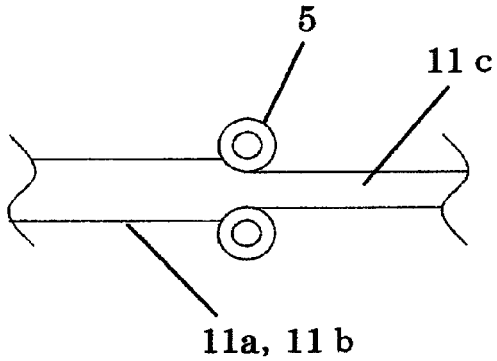
FIGS. 6A and 6B are explanatory views showing the details of the wire working device shown in FIG. 5.
Figure 6B:
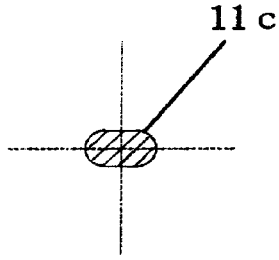

Concerning the winding apparatus of embodiment 2, electric wire working devices 2*a* and 2*b* may be added for an example. FIG. 5 is an explanatory view showing the outline of the electric wire working device adopted in the winding apparatus, and FIGS. 6A and 6B are explanatory views showing the details of the electric wire working device shown in FIG. 5. FIG. 6A is an explanatory view of a working roller, and FIG. 6B is a sectional view of the electric wire formed into a flat rectangular shape. As shown in FIG. 5, by forcefully feeding the electric wires 11*a* and 11*b* having a round section for example, into the working roller 5 by the feeding device 4, the electric wires 11*a* and 11*b* can be flattened from the round shape and worked and formed into the flat rectangular shape 11*c*. The electric wires 1*a*, 1*b*, 11*a* and 11*b* are an electric wire coated by winding a resin, namely, a film-like material spirally thereon, or an electric wire coated with a layer such as an enamel layer. These electric wires are formed by being rolled at a high pressure (a force of the order of ton) in such a coated state.

Embodiment 3

Figure 7A:
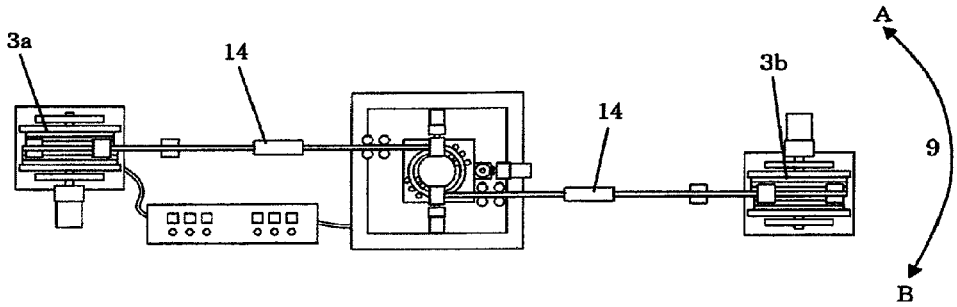
FIGS. 7A and 7B are general schematic views showing embodiment 3 of a winding apparatus of a multi-stage coil for a transformer according to the present invention.
Figure 7B:
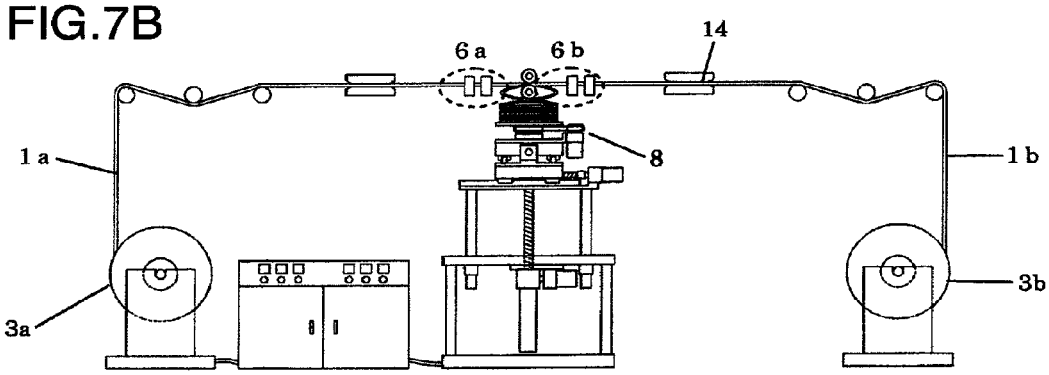

FIGS. 7A and 7B are general schematic views showing embodiment 3 of the winding apparatus of the multi-stage coil for a transformer according to this invention, FIG. 7A is a plane view, and FIG. 7B is a front view. Embodiment 3 which is shown in FIGS. 7A and 7B adopts a disk winding machine as shown in Japanese Patent No. 3996005 described above, in other words, a winding apparatus in which two or more systems including a system extending from the wire drum 3*a* to a forming part 6*a* through the feeding device 14, and a system extending from the wire drum 3*b* to a forming part 6*b* through the feeding device 14 are respectively disposed in a plane layout, and the electric wires respectively formed in the forming parts 6*a* and 6*b* in the respective systems are superimposed at the wind-up part 8 disposed near the center so as to be stacked in layers into a disk winding shape. The winding apparatus is an apparatus which may be called a plane double type.

In embodiment 3, the feeding device 14, the forming parts 6*a* and 6*b* and the like do not have to be disposed in a confronting direction in the winding apparatus as shown in FIGS. 7A and 7B, but may be disposed in any of A direction and B direction of the arrow 9, and may be disposed in any direction, for example, so as to be orthogonal to each other at 90 degrees as long as mutual interference does not occur.

Embodiment 4

Figure 8:
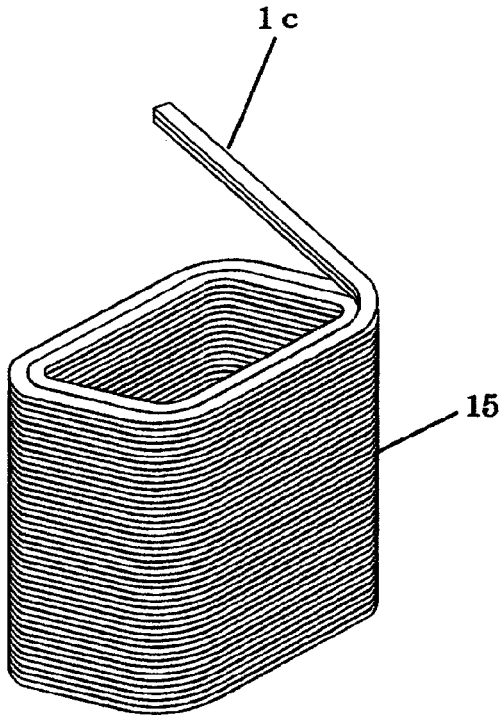
FIG. 8 is a bird's eye view of a coil for a transformer according to the present invention.
Figure 9:
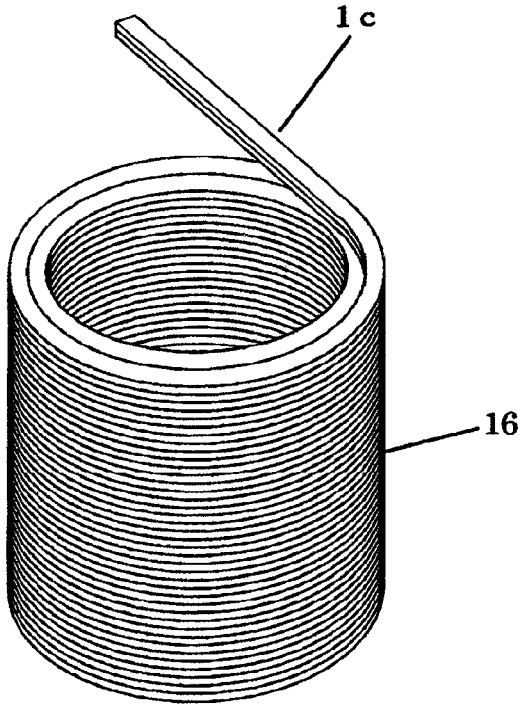
FIG. 9 is a bird's-eye view of another coil for a transformer according to the present invention.

FIGS. 8 and 9 are bird's eye views of the coils for a transformer according to the present invention. Since electric wires are formed in a superimposed state 1*c*, and coils 15 and 16 for a transformer are manufactured, high capacity can be achieved. FIG. 8 shows a coil of which the winding state is rectangular, and FIG. 9 shows a coil of which the winding state is circular. These coils for a transformer are finally molded entirely, and are manufactured as mold coils for a transformer.

Embodiment 5

Figure 10A:
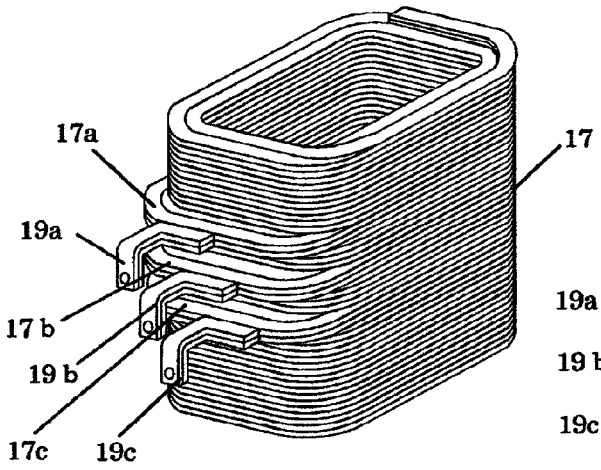
FIGS. 10A and 10B are bird's-eye views of another coil for a transformer according to the present invention.
Figure 10B:
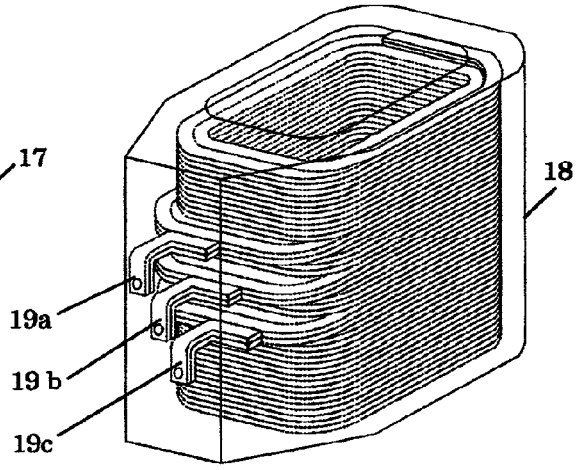
Figure 11A:
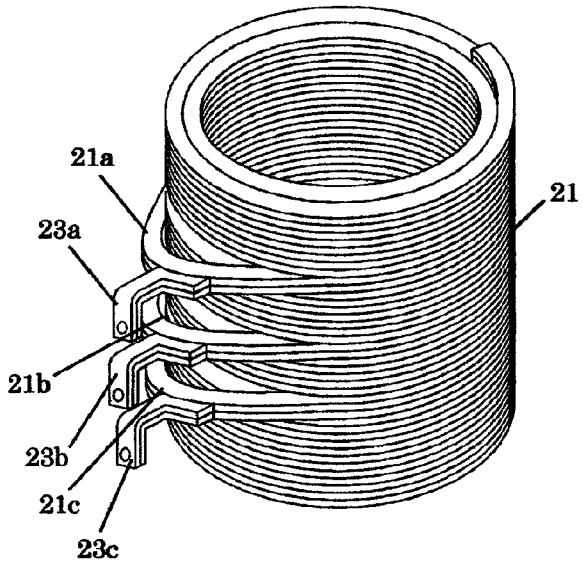
FIGS. 11A and 11B are bird's-eye views of still another coil for a transformer according to the present invention.
Figure 11B:
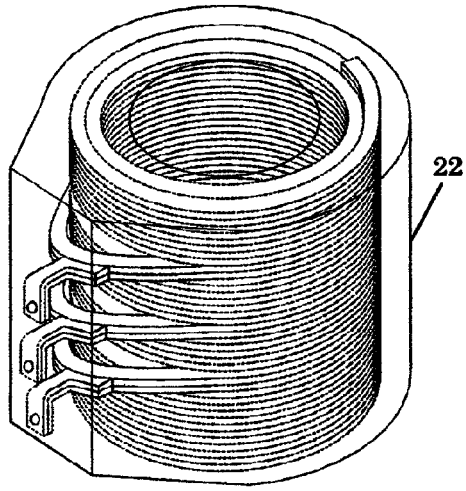

FIGS. 10A and 10B, and FIGS. 11A and 11B are bird's eye views of the coils for a transformer according to the present invention. FIGS. 10A and 10B are examples showing a coil 17 with the winding state being rectangular, FIG. 10A is a view showing the coil 17, and FIG. 10B is a view showing a mold which is applied to the entire coil 17 in a transparent state. FIGS. 11A and 11B show examples showing a coil 21 of which the winding state is circular, FIG. 11A is a view showing the coil 21, and FIG. 11B is a view showing a mold which is applied to the entire coil 21 in a transparent state. In the example shown in FIGS. 10A and 10B, in order to select the voltage to be extracted, overhanging portions 17*a* to 17*c* (rectangles having long sides) which extend outside from intermediate coil portions corresponding to extraction positions are formed and are led out while tap wires 19*a* to 19*c* to be terminals are connected thereto. In the examples shown in FIGS. 11A and 11B, in order to select the voltage to be extracted, overhanging portions 21*a* to 21*c* (ovals) which extend outside from intermediate coil portions corresponding to extraction positions are formed and are led out while tap wires 23*a* to 23*c* to be terminals are connected thereto. These coils 17 and 21 for a transformer are entirely molded 18 and 22 finally, and are manufactured as mold coils for a transformer. The tap wires 19*a* to 19*c* and 23*a* to 23*c* are led to the outside of the molds 18 and 22, have the same sectional area as the two electric wires, and are welded to the coils with silver solder, for example.

The present invention relates to a manufacturing apparatus of a multi-stage coil with a plurality of wires, and a transformer, which can increase the electric wire sectional area of a coil and can increase the capacity, since at least two or more electric wires are combined by forming and the coil is wound in multiple stages in a mold transformer.

It should be further understood by those skilled in the art that although the above description has been made on the embodiments, the present invention is not limited to thereto, and various changes and modifications may be made within the spirit of the present invention and the scope of the accompanying claims.

The invention claimed is:

1. A winding method of a multi-stage coil for a transformer including: rolling and forming an electric wire portion to be a curved portion when winding a plurality of flat rectangular electric wires which are supplied separately or in a superimposed state into a disk shape; and stacking the flat rectangular electric wires having been rolled and formed in layers while winding the flat rectangular electric wires into the disk shape, further including:

forming the plurality of flat rectangular electric wires having the same shape and the same size, and stacking the plurality of formed flat rectangular electric wires in layers while winding the flat rectangular electric wires into the disk shape in a state in which the flat rectangular electric wires are superimposed vertically.

2. The winding method of a multi-stage coil for a transformer according to claim 1, wherein rolling and forming the electric wire portion to be a curved portion includes curving by more firmly rolling an outer side of the curved portion in a curvature radius direction than an inner side of the curved portion.

3. The winding method of a multi-stage coil for a transformer according to claim 1, further comprising leading out a tap wire from the plurality of flat rectangular electric wires, such that the tap wire is electrically connected to the plurality of flat rectangular electric wires and the tap wire allows a predetermined voltage to be extracted.

4. The winding method of a multi-stage coil for a transformer according to claim 3, further comprising integrating the plurality of flat rectangular electric wires in a superimposed state by pinching the plurality of flat rectangular electric wires in a width direction and a thickness direction.

5. The winding method of a multi-stage coil for a transformer according to claim 1, further comprising integrating the plurality of flat rectangular electric wires in a superimposed state by pinching the plurality of flat rectangular electric wires in a width direction and a thickness direction.

6. The winding method of a multi-stage coil for a transformer according to claim 3, wherein rolling and forming the electric wire portion to be a curved portion includes curving by more firmly rolling an outer side of the curved portion in a curvature radius direction than an inner side of the curved portion.

7. A multi-stage coil for a transformer, which is formed by stacking a plurality of flat rectangular electric wires in layers while the plurality of flat rectangular electric wires are wound into a disk shape in a state in which the flat rectangular electric wires are superimposed vertically, the plurality of flat rectangular electric wires being rolled and formed to have an electric wire portion to be a curved portion when being wound into the disk shape.

8. The multi-stage coil for a transformer according to claim 7, wherein the curved portion is formed by more firmly rolling an outer side of the curved portion in a curvature radius direction than an inner side of the curved portion.

9. The multi-stage coil for a transformer according to claim 7, which is further formed by integrating the plurality of flat rectangular electric wires in a superimposed state by pinching the plurality of flat rectangular electric wires in a width direction and a thickness direction.

10. The multi-stage coil for a transformer according to claim 7, wherein a tap wire for extracting a predetermined voltage is led out from the plurality of flat rectangular electric wires in a state of being electrically connected thereto.

11. The multi-stage coil for a transformer according to claim 10, which is further formed by integrating the plurality of flat rectangular electric wires in a superimposed state by pinching the plurality of flat rectangular electric wires in a width direction and a thickness direction.

12. The multi-stage coil for a transformer according to claim 10, wherein the curved portion is formed by more firmly rolling an outer side of the curved portion in a curvature radius direction than an inner side of the curved portion.

13. A multi-stage coil for a transformer which is wound by a winding method including the following steps:

rolling and forming an electric wire portion to be a curved portion when winding a plurality of flat rectangular electric wires which are supplied separately or in a superimposed state into a shape; and stacking the flat rectangular electric wires having been rolled and formed in layers while winding the flat rectangular electric wires into the disk shape, further including:

forming the plurality of flat rectangular electric wires having the same shape and the same size, and stacking the plurality of formed flat rectangular electric wires in layers while winding the flat rectangular electric wires into the disk shape in a state in which the flat rectangular electric wires are superimposed vertically.

14. The multi-stage coil for a transformer according to claim 13, wherein the winding method by which the multi-stage coil is wound further comprises a step of leading out a tap wire from the plurality of flat rectangular electric wires, such that the tap wire is electrically connected to the plurality of flat rectangular electric wires and the tap wire allows a predetermined voltage to be extracted.

15. The multi-stage coil for a transformer according to claim 14, wherein the winding method by which the multi-stage coil is wound further comprises a step of integrating the plurality of flat rectangular electric wires in a superimposed state by pinching the plurality of flat rectangular electric wires in a width direction and a thickness direction.

16. The multi-stage coil for a transformer according to claim 14, wherein in the winding method by which the multi-stage coil is wound, rolling and forming the electric wire portion to be a curved portion includes curving by more firmly rolling an outer side of the curved portion in a curvature radius direction than an inner side of the curved portion.

17. The multi-stage coil for a transformer according to claim 13, wherein in the winding method by which the multi-stage coil is wound, rolling and forming the electric wire portion to be a curved portion includes curving by more firmly rolling an outer side of the curved portion in a curvature radius direction than an inner side of the curved portion.

18. The multi-stage coil for a transformer according to claim 13, wherein the winding method by which the multi-stage coil is wound further comprises a step of integrating the plurality of flat rectangular electric wires in a superimposed state by pinching the plurality of flat rectangular electric wires in a width direction and a thickness direction.

* * * * *